US006173479B1

(12) United States Patent
Howell

(10) Patent No.: US 6,173,479 B1
(45) Date of Patent: Jan. 16, 2001

(54) BUTTON SNAP FLAP CLOSURE

(75) Inventor: Clarence F. Howell, Bridgton, ME (US)

(73) Assignee: Down East, Inc., Bridgton, ME (US)

( * ) Notice: Under 35 U.S.C. 154(b), the term of this patent shall be extended for 0 days.

(21) Appl. No.: 09/173,435

(22) Filed: Oct. 15, 1998

(51) Int. Cl.[7] ..... A44B 17/00
(52) U.S. Cl. ..... 24/580
(58) Field of Search ..... 24/580–586, 575–577; 292/DIG. 50; 150/149, 118; 190/902, 119, 120; 383/86; 229/77, 125.23, 125.37, 78.2

(56) References Cited

U.S. PATENT DOCUMENTS 167,663 * 9/1875 Hanau et al. .
172,170 * 1/1876 Read .
1,149,657 * 8/1915 Loft .
2,822,013 * 2/1958 Renz .
2,940,149 * 6/1960 O'Connor .
2,978,769 * 4/1961 Harrah .
3,021,883 * 2/1962 Kanner et al. .
3,325,084 * 6/1967 Ausnit .
3,484,907 * 12/1969 Elsenheimer .
3,518,727 * 7/1970 Eberle et al. .
3,955,245 * 5/1976 Ballin .
3,958,750 * 5/1976 Prybeck .
3,988,812 * 11/1976 Kanzaka .
4,706,297 * 11/1987 Ausnit .
4,727,630 * 3/1988 Alan .
5,267,679 * 12/1993 Kamaya et al. .
5,896,629 * 4/1999 Van Hooreweder .

* cited by examiner

*Primary Examiner*—James R. Brittain
(74) *Attorney, Agent, or Firm*—Samuels, Gauthier & Stevens

(57) ABSTRACT

A button snap flap closure for a pocket having a flap which overlaps a surface of the pocket. The closure comprises an elongated keeper secured to the pocket, the keeper having a ridge comprised of ribs in parallel relationship formed therein and a clip having a top portion secured to the flap. The clip is comprised of depending walls adapted to engage the ribs of the keeper.

6 Claims, 2 Drawing Sheets

BUTTON SNAP FLAP CLOSURE

BACKGROUND OF THE INVENTION

1. Field of the Invention

This invention relates to button-snap flap closures.

2. Description of Relevant Art

Button-snap pocket flap closures now in widespread use have several serious limitations when used in military applications. They are difficult to close with one hand. They are difficult to close in an environment where it is not possible to visually align the snap's circular top and bottom halves; the mating halves must be precisely aligned on both the x and y axes to lock. The attachment points are not adjustable. The flap cannot be secured tightly over the pocket's contents if the volume in the pocket changes. For example, a pocket flap designed to carry three ammunition clips will allow two clips to bounce and rattle as the soldier moves. The present invention is directed towards eliminating the aforementioned limitations of the prior art button snap flap closures.

SUMMARY OF THE INVENTION

The invention provides a pocket flap closure that can be easily opened and closed with one hand, can be used without looking and allows the flap to be tightened as needed to minimize noise and movement of various pocket contents.

Broadly the invention comprises a button snap flap closure for a pocket having a flap, which flap overlies a surface of the pocket. The closure comprises an elongated keeper which keeper has a ridge characterized by longitudinal ribs formed on its sides and locking teeth on its upper surface.

A block-like clip is secured to the underside of the flap. The clip has a top portion and depending sides with inwardly extending locking teeth. The underside of the clip has a locating recess formed therein. The flap is pulled taught, the clip is pushed into the keeper, the locking teeth of the clip snap over the ribs of the keeper and lock the clip to the keeper. A locking tooth on keeper engages the recess in the clip to prevent movement of the clip along the longitudinal axis of the keeper.

DETAILED DESCRIPTION OF THE PREFERRED EMBODIMENTS

Figure 1:
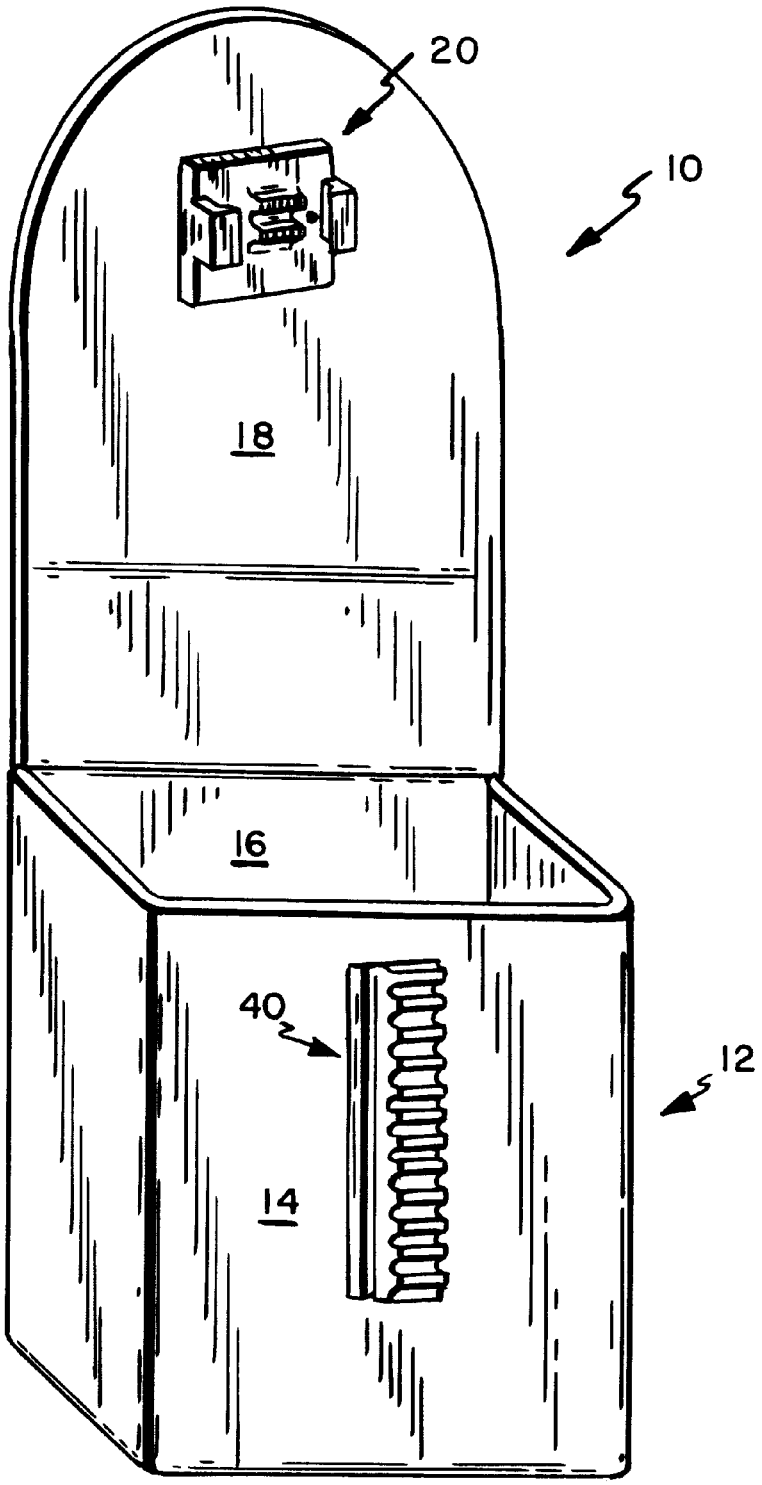
FIG. 1 is a perspective view of a button snap flap closure attached to a pocket with a closure flap.

Referring to FIG. 1, a pack 10 is shown and comprises a pocket 12, having a front panel 14 and a rear panel 16. A flap 18 is formed integrally with the rear panel 16 and extends over the front panel 14. A clip 20 is secured to the underside of the flap 18 and a keeper 40 is secured to the outside of the front panel 14.

Figure 2:
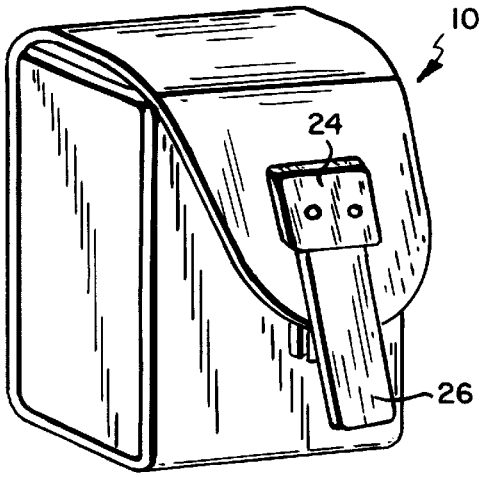
FIG. 2 is a perspective view of a full pocket of FIG. 1.
Figure 3:
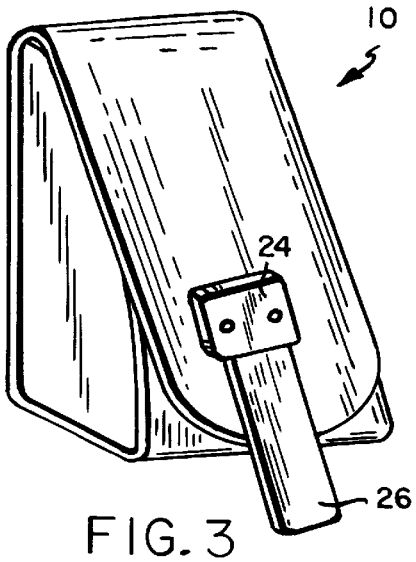
FIG. 3 is a perspective view of a pocket of FIG. 1 either partially full or empty.

The clip 20 can be secured to the keeper 40 at any location along the longitudinal axis of the keeper 40. As shown in FIG. 2, the snap 20 is secured to the top of the keeper 40 with a full pocket 10. As shown in FIG. 3, with the pocket 10 only partially full or empty the snap 20 is secured to the lower end of the keeper 40.

Figure 4:
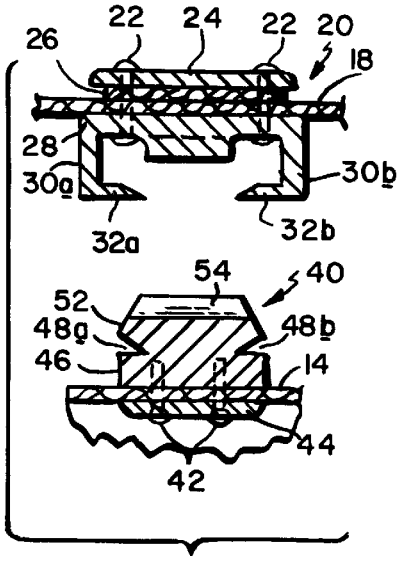
FIG. 4 is an end telescopic view of the keeper and clip disengaged.

To secure the clip 20 to the flap 18, referring to FIG. 4, pins 22 extend from a plate 24, pass through a strap 26 and the flap 18 (fabric) and are then staked in the clip 20. To secure the keeper 40 to the front panel 14, referring to FIG. 4, pins 42 extend from a plate 44 through the panel 14 (fabric) and are then staked in the keeper 40.

Figure 5A:
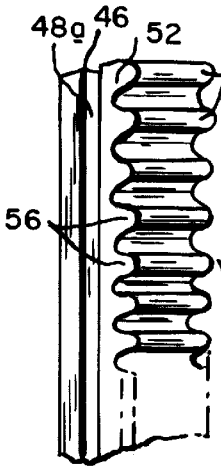
FIG. 5*a* is a perspective view of a keeper.

Referring to FIGS. 4 and 5*a*, the keeper 40 is shown in greater detail and comprises a base 46 and side grooves 48*a* and 48*b* which define a ridge 50 having locking ribs 52. The ridge 50 is characterized by locking teeth 54 having convex surfaces 56.

Figure 5B:
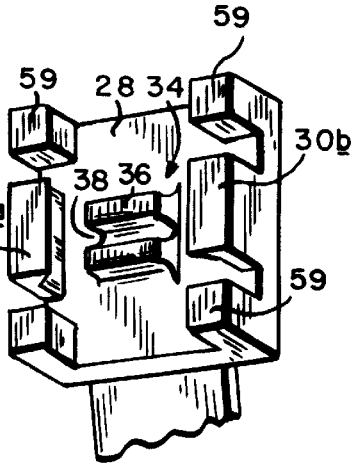
FIG. 5*b* is a perspective view of a mating clip.

Referring to FIGS. 4 and 5*b*, the snap 20 is shown in greater detail and comprises a top 28 having depending walls 30*a* and 30*b* terminating in inwardly extending locking teeth 32*a* and 32*b*. On the underside of the top 28 is a depending locating block 34 having two locking teeth 36, having convex surfaces 58, which teeth 36 define a recess 38. The block 34 is centered with reference to the walls 30*a* and 30*b*. Four protecting pillars 59 extend from the top 28 and terminate in surfaces which are coplanar wit the surfaces of the locking teeth 32.

Figure 6:
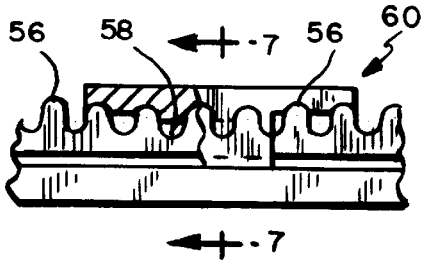
FIG. 6 is a side partially sectional view of the button snap with the clip secured to the keeper.
Figure 7:
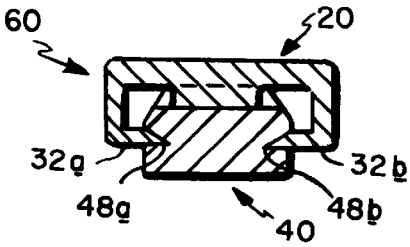
FIG. 7 is an end view of FIG. 6 taken along lines 7—7 of FIG. 6 showing the keeper and clip engaged.

The clip 20 and keeper 40 comprise a button snap flap closure 60 shown in FIGS. 6 and 7. To secure the flap 18 to the front panel 14, the clip 20 slides along the keeper 40 until the flap 18 feels secure or taunt. The clip 20 is then pressed into the keeper 40. The convex surfaces 56 and 58 self-align the clip 20 and the keeper 40. The locking teeth 32 of the clip 20 snap over the ribs 52 with the locking teeth 32 received in the side grooves 48 thereby locking the clip 20 to the keeper 40.

The recess 38 of the clip 20 is engaged by a locking tooth 52 of the keeper 40 which prevents movement of the clip 20 along the axis of the keeper 40.

The closure 60 of the invention accomplishes four things: 1) the clip 20 fixed to the pocket flap 18 can be attached anywhere along the length of the ribbed ridge 50 fixed to the outside of the pocket. The further down the clip 20 is attached to the ribbed ridge 50, the tighter the pocket flap is drawn down over the pocket opening. 2) The high profile of the ribbed ridge 50 easily catches the opening on the clip 20 (ease of alignment on the y axis). 3) The length of the ribbed ridge 50 provides a large target for the clip 20 to engage (ease of alignment on the x axis). 4) The length and stiffness of the ribbed ridge 50 provides a stable base that keeps the mating ribs 52 of the ridge 50 and the clip 20 aligned as the clip is pressed into the locked position.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention what I now claim is:

1. A button snap flap closure for a pocket having a flap, which flap overlaps a surface of the pocket which closure comprises:

an elongated keeper, the keeper having a ridge, the ridge having ribs in parallel relationship formed therein, the ribs being formed in part by side grooves which grooves underlie the ribs; and a clip having a top portion, the clip having depending walls adapted to engage the ribs of the keeper and characterized by inwardly extending locking teeth, the clip further comprising a plurality of pillars which are spaced apart from the depending walls to protect the walls, whereby when the clip is engaged to the keeper the inwardly extending locking teeth are received in the grooves.

2. The closure of claim 1 wherein the keeper has a top surface characterized by locking teeth and the clip has a recess which engages a locking tooth when the clip is secured to the keeper to prevent movement of the clip along the longitudinal axis of the keeper.

3. The closure of claim 2 wherein the locking teeth are characterized by convex surfaces.

4. The closure of claim 3 wherein the clip is secured to the flap.

5. The closure of claims 1 or 2 wherein the recess of the clip is centered with reference to the depending arms.

6. The closure of claim 5 wherein the elongated keeper is secured to the surface of the pocket.

* * * * *